US008232921B2

(12) United States Patent
Guthoerl et al.

(10) Patent No.: US 8,232,921 B2
(45) Date of Patent: Jul. 31, 2012

(54) HALF-MODE SUBSTRATE INTEGRATED ANTENNA STRUCTURE

(75) Inventors: Marc Guthoerl, Stetten (DE); Stefan Koch, Oppenweiler (DE)

(73) Assignee: Sony Corporation, Tokyo (JP)

( * ) Notice: Subject to any disclaimer, the term of this patent is extended or adjusted under 35 U.S.C. 154(b) by 453 days.

(21) Appl. No.: 12/349,075

(22) Filed: Jan. 6, 2009

(65) Prior Publication Data

US 2009/0243941 A1 Oct. 1, 2009

(30) Foreign Application Priority Data

Mar. 31, 2008 (EP) ..... 08153742

(51) Int. Cl.
*H01Q 1/38* (2006.01)

(52) U.S. Cl. ..... 343/700 MS; 343/772

(58) Field of Classification Search ..... 343/700 MS, 343/770, 771, 772
See application file for complete search history.

(56) References Cited

U.S. PATENT DOCUMENTS

| | | | | |
|---|---|---|---|---|
| 4,344,052 | A * | 8/1982 | Davidson | 333/222 |
| 4,916,458 | A * | 4/1990 | Goto | 343/771 |
| 2009/0066597 | A1* | 3/2009 | Yang et al. | 343/771 |
| 2010/0134376 | A1* | 6/2010 | Margomenos et al. | 343/848 |
| 2010/0321265 | A1* | 12/2010 | Yamaguchi et al. | 343/771 |

FOREIGN PATENT DOCUMENTS

CN 101 026 263 A 8/2007

OTHER PUBLICATIONS

Wei Hong, et al., "Integrated Microwave and Millimeter Wave Antennas Based on SIW and HMSIW Technology", Antenna Technology: Small and Smart Antennas Metamaterials and Applications, IEEE, XP031174853, Mar. 1, 2007, pp. 69-72.

Wei Hong, et al., "Design and Implementation of Low Sidelobe Slot Array Antennas with Full and Half Mode Substrate Integrated Waveguide Technology", Proceedings of the 37th European Microwave Conference, IEEE, XP002486402, Dec. 17, 2007, 2 pgs.

(Continued)

*Primary Examiner* — Hoanganh Le
(74) *Attorney, Agent, or Firm* — Oblon, Spivak, McClelland, Maier & Neustadt, L.L.P.

(57) ABSTRACT

The present invention relates to a half mode substrate integrated antenna structure 1, 10, 11 for electromagnetic signals, comprising a substrate 2 with a top 2*a* and a bottom side 26, said substrate being essentially of a flat shape with a main plane M, a conductive layer 3*a* arranged on said top and a conductive layer 3*b* arranged on said bottom side, a series of conductive vias 4 extending between the conductive layers 3*a*, 3*b* of the top and the bottom side of the substrate so that a waveguide having a feeding end 5 and an antenna end 6 is formed, wherein said antenna end 6 is formed by end regions 7 of said conductive layers 3*a*, 3*b* and said substrate 2 so that a radiation pattern of said antenna structure 1 essentially extends in the main plane M.

19 Claims, 3 Drawing Sheets

OTHER PUBLICATIONS

Figure 1:
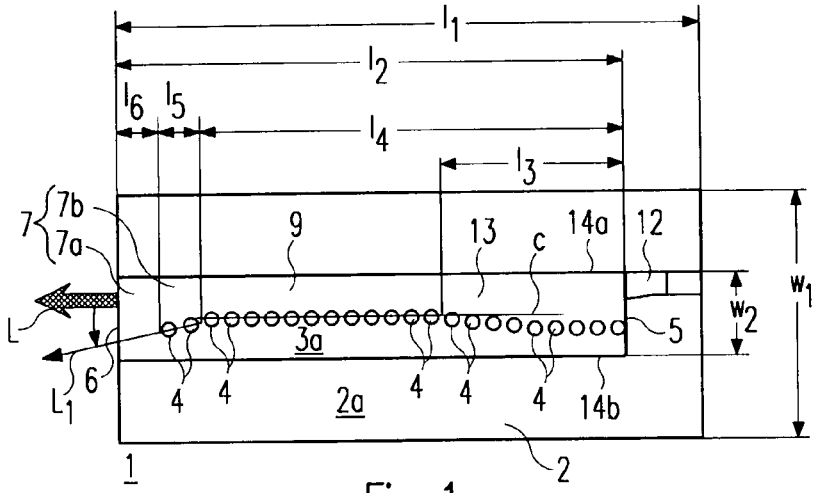

Wei Hong, et al., "Half Mode Substrate Integrated Waveguide: A New Guided Wave Structure for Microwave and Millimeter Wave Application", IEEE, Millimeter Waves Systems, State Key Lab of Millimeter Waves, Department of Radio Engineering, Southeast University, 2006, p. 219.

Ke Wu, et al., "The Substrate Integrated Circuits—A New Concept for High-Frequency Electronics and Optoelectronics", Microwave Review, Dec. 2003, pp. 2-9.

Wei Hong, et al., "Integrated Microwave and Millimeter Wave Antennas Based on SIW and HMSIW Technology", IEEE, State Key Lab of Millimeter Waves, Department of Radio Engineering, College of Information Science and Engineering, Southeast University, 2007, pp. 69-72.

* cited by examiner

HALF-MODE SUBSTRATE INTEGRATED ANTENNA STRUCTURE

The present invention relates to a half-mode substrate integrated antenna structure for radiating and/or receiving electromagnetic signals.

The half-mode substrate integrated antenna structure according to the present invention hereby bases on the known substrate integrated wave guide technology, in which wave guides for microwave and millimeter wave applications are created by placing metallic layers on a top and a bottom side of a dielectric substrate and by creating a channel for the electromagnetic signals by means of series or rows of conducting vias. Such wave guides usually have a length which is two or more times larger than the width and a very small height as compared to the width so that a high integration of these wave guides is possible. Further, these wave guides can be manufactured at low cost, for example by a printed circuit board fabrication process, while still providing a high performance. Normal (full-mode) wave guides comprise two at least partially parallel series or rows of conducting vias connecting the two conducting layers on the top and the bottom side of the substrate, whereby the electromagnetic signals are guided in between the two rows or series of conducting vias. More recent developments have found that it is possible to build half-mode substrate integrated wave guides which only comprise a single row or series of conducting vias and therefore have only half the size of a full-mode substrate integrated wave guide. Hereby, by basically cutting the full-mode substrate integrated wave guide in half in the length direction creates an open side along the middle between the formerly two rows of conducting vias, whereby the open side is almost equivalent to a perfect magnetic wall due to the high ratio of width to height. In other words, half-mode substrate integrated wave guides provide almost the same performance as full-mode substrate integrated wave guides, but with half the size. It has further been found that such half-mode substrate integrated wave guides can be used as antennas.

The object of the present invention is to propose a substrate integrated antenna structure enabling a high integration and more versatile applications as compared to the prior art.

The above-object is achieved by a half-mode substrate integrated antenna structure for radiating and/or receiving electromagnetic signals according to claim 1. The half-mode substrate integrated antenna structure according to the present invention comprises a substrate made of a dielectric material with a top and a bottom side, the substrate being at least partially of a flat shape having a main plane, a conductive layer arranged on said top and a conductive layer arranged on said bottom side of the substrate, a series of conductive vias extending between the conductive layers of the top and the bottom side of the substrate so that a wave guide having a feeding end and an antenna end is formed, whereby said antenna end is formed by end regions of said conductive layers and said substrate so that at a radiation pattern of said antenna structure essentially extends in the main plane.

The half-mode substrate integrated antenna structure according to the present invention is particularly adapted to operate in broad band applications, preferably in the microwave and/or millimeter wave range. The antenna structure of the present invention has a small size and can therefore be integrated easily, is simple to manufacture and can be used for various applications in a very flexible manner. Particularly, since the antenna structure of the present invention has a radiation pattern which is essentially extending in the main plane of the antenna structure, a plurality of antenna structures according to the present invention can be integrated very efficient by, i.e. in other words it is possible to arrange a plurality of antenna structures according to the present invention next to each other.

Advantageously, the conductive layers in the substrate at the antenna end form an open end structure.

Further advantageously, the series of vias extends along the length of said antenna structure from said feeding end towards said antenna end wherein end parts of said end regions of said conductive layers are free of conductive vias. Hereby, advantageously, the length of said end parts is between 3% and 15%, preferably between 5% and 10%, of the length of said conductive layers. Further advantageously, the series of vias in intermediate parts of said end regions adjacent to said end parts is arranged essentially along in middle line of said conductive layers in the length direction so that the radiation pattern of said antenna structure essentially extends in the length direction of the antenna structure. Alternatively, the series of vias in intermediate parts of said end regions adjacent to said end parts is arranged essentially at an angle to a middle line of said conductive layers in the length direction so that the radiation pattern of said antenna structure essentially extends in the direction of said angle. Advantageously, the length of said intermediate region is between 3% and 15%, preferably between 5% and 10%, of the length of said conductive layers.

Advantageously, the wave guide comprises a middle region in which the series of vias is arranged essentially along a straight line. The series of vias acts as a wave or field guide for the electromagnetic signals in cooperation with the magnetic wall. Hereby, the straight line is advantageously the middle line of said conductive layers in their length direction. Further advantageously, the length of the middle region is between 30% and 70%, preferably between 40% and 60%, of the length of said conductive layers.

Advantageously, the antenna structure of the present invention further comprises a feeding structure coupled to said feeding end of said wave guide at or adjacent to a side wall thereof, wherein said wave guide comprises a feeding region adjacent to said feeding end, wherein the series of vias arranged in said feeding region is arranged closer to an opposite side wall of the wave guide and to the side wall at or adjacent to which the feeding structure is coupled. Hereby, the length of said feeding region is advantageously between 20% and 50%, preferably between 30% and 40%, of the length of said conductive layers.

Figure 2:
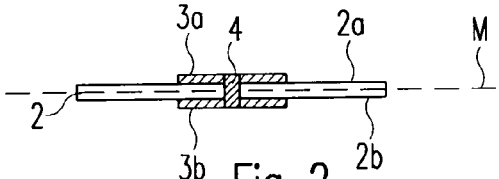
Figure 3:
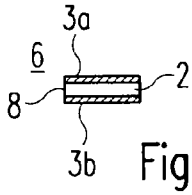
Figure 4A:
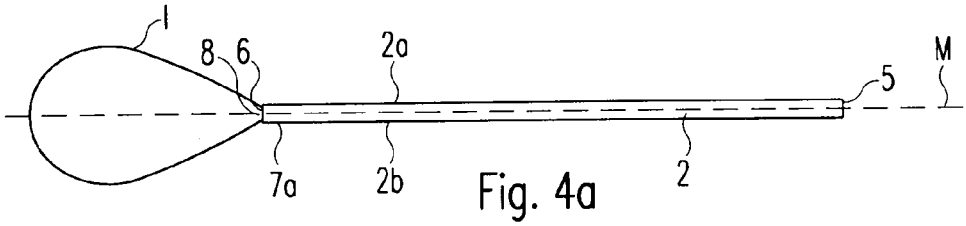
Figure 4B:
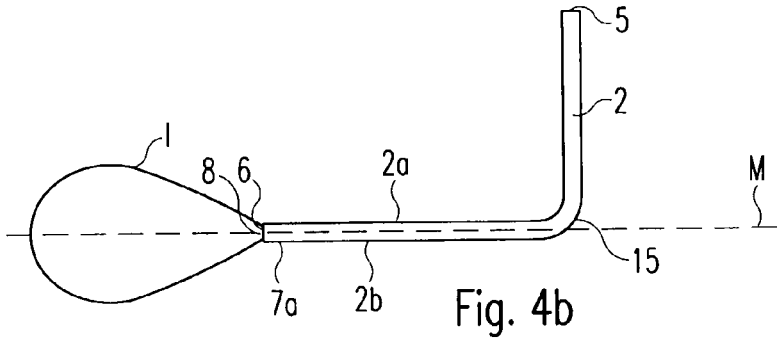
Figure 5:
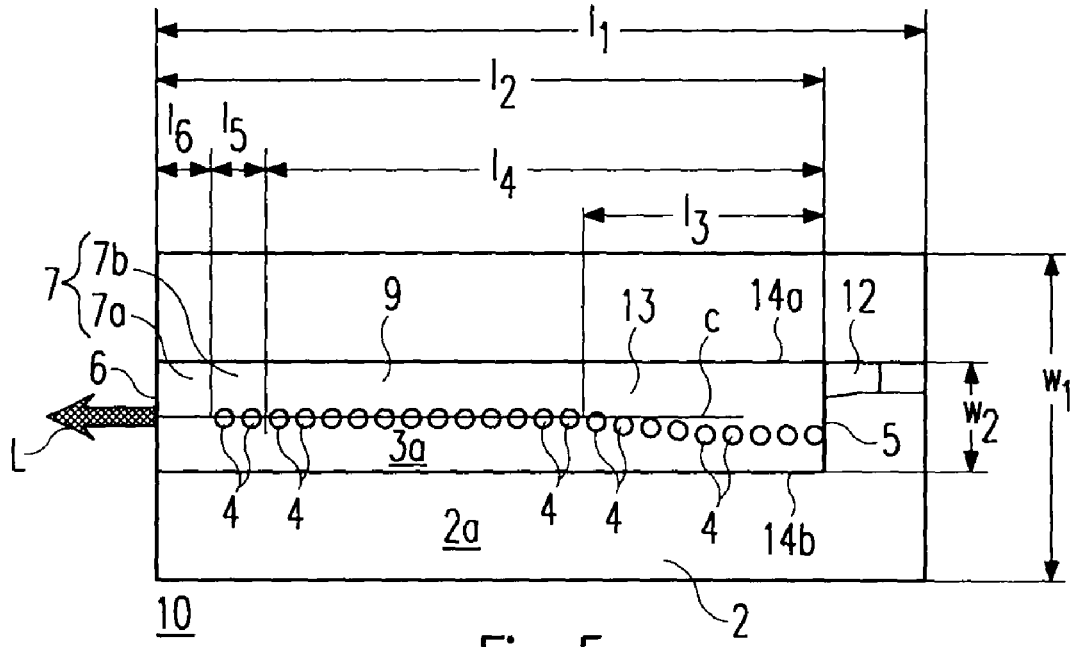
Figure 6:
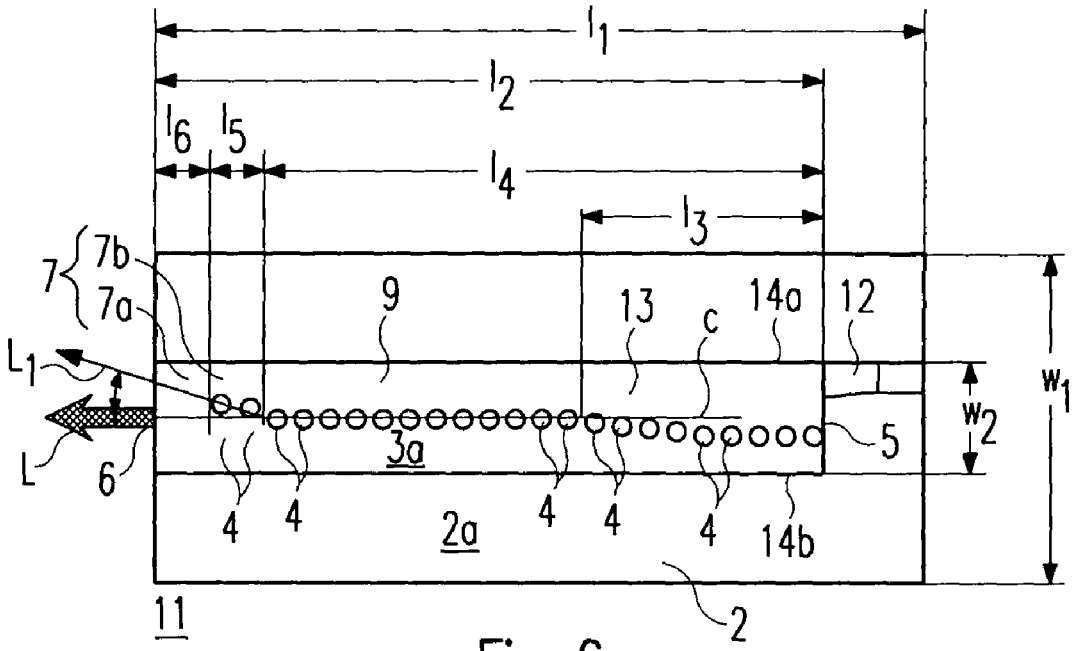
Figure 7:
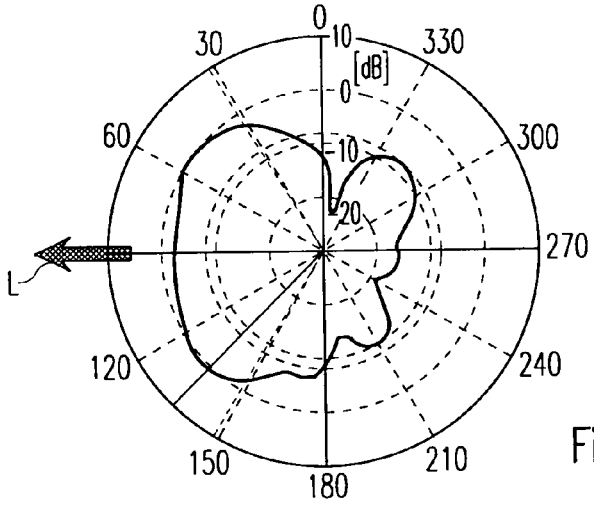
Figure 8:
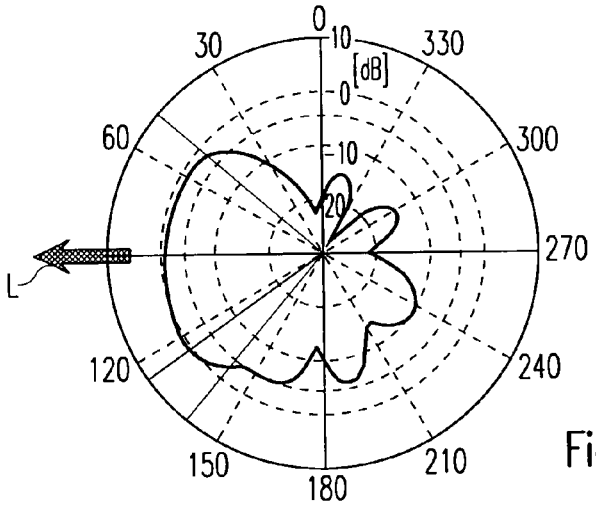
Figure 9:
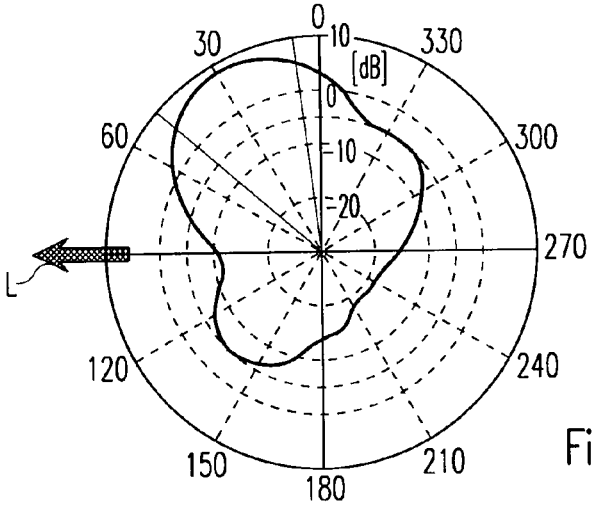

The present invention is further explained in the following detailed description of preferred embodiments in relation to the enclosed drawings, in which FIG. 1 shows a top view of an antenna structure according to a first embodiment of the present invention, FIG. 2 shows a cross section in the width direction of the antenna structure shown in FIG. 1, FIG. 3 shows a side view of a cut-out of the antenna end of the antenna structure of FIG. 1, FIG. 4*a* shows a schematic side view of an antenna structure of the present invention with its radiation pattern, FIG. 4*b* shows a schematic side view of an alternative antenna structure of the present invention, FIG. 5 shows a top view of a second embodiment of an antenna structure of the present invention, FIG. 6 shows a top view of a third embodiment of an antenna structure according to the present invention, FIG. 7 shows a radiation pattern of an antenna structure according to the first embodiment, FIG. 8 shows a radiation pattern of an antenna structure of the second embodiment, and FIG. 9 shows a radiation pattern of an antenna structure of the third embodiment.

FIG. 1 shows a top view of a half-mode substrate integrated antenna structure 1 according to a first embodiment of the present invention. The antenna structure 1 comprises a substrate 2 having a top side 2*a* and a bottom side 2*b*, which can for example be seen in the cross section along the width direction of the antenna structure 1 shown in FIG. 2. The substrate 2 of this embodiment essentially has a flat shape and extends in a main plane M (cf. FIG. 2 and FIG. 4). In other words, the substrate has a very small height as compared to the width and the length. In FIGS. 1, 5 and 6, the main plane M is identical to the drawing plane. In the embodiment shown in FIG. 1, the substrate 2 has a length which is slightly two times larger than the width. However, the length of the substrate 2 can be a multitude of times larger than the width, or can be about the same as the width depending on the wanted application. The substrate 2 may comprise or may entirely be made of a dielectric material, i.e. material with a dielectric constant unequal 1. The dielectric material of the substrate 2 can hereby be a flexible or an inflexible material depending on the desired application. Alternatively or additionally the substrate may at least partially comprise air, e.g. between the conductive layers 3*a* and 3*b*.

A conductive layer 3*a* is arranged on the top side 2*a* of the substrate and a conductive layer 3*b* is arranged on the bottom side 2*b* of the substrate 2, cf. FIG. 2. The conductive layers 3*a* and 3*b* are in register with each other, in other words, the conductive layers 3*a* and 3*b* are completely matching and in line with each other. It can be seen in FIG. 1 (as well as in FIGS. 5 and 6), that the length $l_2$ of the conducting layers 3*a* and 3*b* is less than the length $l_2$ of the substrate 2. The reason is that an additional feeding structure 12 in form of printed conducting lines is present on the top side 2*a* and optionally also on the bottom side 2*b* of the substrate 2. The material of the conducting layers is for example metal, but can be any other conducting material. The material of the feeding lines 12 can also for example be metal or any other conducting material. The conductive layers 3*a* and 3*b* are for example printed onto the substrate 2 by printed circuit board technology. It is also possible to apply the conductive layers 3*a*, 3*b* by means of any other suited technology, e.g. by an integrated circuit board technology. The width $w_2$ of the conductive layers 3*a*, 3*b* is smaller than the width $w_1$ of the substrate 2 in the embodiment shown in FIGS. 1, 5 and 6. However, it is possible that the width $w_2$ of the conductive layer 3*b* on the bottom side 2*b* is the same as the width $w_1$ of the substrate 2, in other words, it is possible that the conductive layer 3*b* extends over the entire width of the substrate 2.

The antenna structure 1 further comprises a series or a row of conductive vias 4 extending between the conducive layers 3*a*, 3*b* so that a wave guide feeding end 5 and an antenna end 6 is formed. The conductive vias 4 are conductive posts or rods connecting the two conductive layers 3*a*, 3*b*, as shown in FIG. 2. Advantageously, the conductive vias are made from material as the conductive layers 3*a*, 3*b*, for example metal. The antenna structure 1 of the present invention only comprises a single series or row of conductive vias 4, thus forming a half-mode antenna structure, whereby the longitudinal side 14*a* of the conductive layers 3*a*, 3*b* forms a magnetic wall for the electromagnetic signals. The conductive vias 4, in the shown embodiment, have a round shape and approximately all the same diameter as well as distance in relation to each other. However, it might be possible that the shape and/or the diameter and/or the distance between the conductive vias may vary depending on the desired application. For example, the vias might have an elliptic, rectangular or any other suitable shape.

On the feeding end of the wave guide, the feeding structure 12 for supplying electromagnetic signals to or from the wave guide is connected at the corner of the longitudinal side 14*a* which forms the magnetic wall forming the electromagnetic signals. In different applications, the feeding structure 12 may not be located directly at the corner but may just be connected closer to the longitudinal side 14*a* forming the magnetic wall than to the opposite longitudinal side 14*b* of the wave guide. The opposite end of the feeding end 5 in the longitudinal direction of the wave guide is an antenna end 6, which is formed by end regions 7 of the conductive layers 3*a*, 3*b* and the substrate 2. The schematic side view of the antenna structure 1 shown in FIG. 4*a* visualizes that the radiation pattern radiated from the antenna end 6 essentially extends in the main plane M of the antenna structure 1. In other words, the radiation pattern does not extend away from the main plane M of the antenna structure 1, but the main lobe l of the radiation pattern essentially extends in and along the main plane M. The antenna end 6 hereby is an open end structure 8, as can be seen in the cut-out of a side view of the antenna structure 1 shown in FIG. 3. In other words, the end parts 7*a* of the conductive layers 3*a*, 3*b* at the antenna end extend to the edge or the side of the subject 2 so that electromagnetic waves guided along the wave guide can be radiated from this open end 8 without obstructions. The side view shown in FIG. 4*a* is a side view of the embodiments shown in FIGS. 1, 5 and 6 of the present invention. FIG. 4*b* shows a side view of an alternative antenna structure according to the present invention, in which the substrate 2 and thus the entire antenna structure is bent, i.e. comprises a bent portion 15. The part of the antenna structure which comprises the antenna end 6 is of a flat shape with the main plane M, and along which the main lobe of the radiation pattern extends, in the same way as described above in relation to FIG. 4*a*. However, the part of the antenna structure comprising the feeding end 5 is bent out of the plane M. In the example shown in FIG. 4*b*, the two parts of the antenna structure which are defined or separated by the bent portion 15 comprise an angle of about 90 degrees. However, any other angle is possible depending on the wanted application. Also, the antenna structure of the present invention, in a further alternative, could be bent in an S-shape or the like. Hereby, it has to be noted that the bent portion 15 (or additional bent portions) should have a radius which is sufficient to ensure that electromagnetic signals directed from the feeding end 5 to the antenna end 6 are not deteriorated. It is to be understood that the alternative shape of the antenna structure shown in FIG. 4*b* can be applied to the first embodiment shown in FIG. 1 as well as to the second embodiment shown in FIG. 5 or the third embodiment shown in FIG. 6. Generally, all embodiments of the internal structure of the present invention describe herein can have an essentially flat shape as shown in FIG. 4*a*, or can have a bent shape as shown in FIG. 4*b* or any other bent shape, S-type shape or any other suitable shape as long as a part of the internal structure comprising the antenna end 6 is essentially and has a main plane M in which or along which the main lobe l of the radiation pattern extends.

The series or row of conductive vias 4 extends along the length of the antenna structure 1 from the feeding end 5 towards the antenna end 6 in a consecutive manner, except that the end parts 7*a* of the end region 7 of the conductive layers 3*a*, 3*b* are free of conductive vias 4. In other words, the end parts 7*a* of the end region 7 bordering the edge or the side of the open end 8 do not have conductive vias. The length $l_6$ of the end parts 7*a* is between 3% and 15%, preferably between 5% and 10% and in the shown example about 7.5% of the length $l_2$ of the conductive layers 3*a*, 3*b*. The end regions 7 further comprise an intermediate part 7*b* arranged adjacent to the end parts 7*a* and a middle region 9 of the conductive layers 3*a*, 3*b*. The intermediate parts 7*b* have conductive vias 4, whereby the arrangement of the vias 4 in the intermediate parts 7*b* influences the direction of the radiation pattern in the main plane M. In the antenna structure 1 of the first embodiment shown in FIG. 1, the vias in the intermediate parts 7*b* are not arranged along the middle line C in the longitudinal direction L of the conductive layers 3*a*, 3*b*, but in an angle, e.g. between 10° and 30° to the longitudinal direction L. In other words, the direction $L_1$, into which the series of vias of the intermediate parts 7*b* of the first embodiment are directed, is at any angle of 10° to 30° in relation to the longitudinal direction L of the antenna structure 1, which results in that the main lobe of the radiation pattern of the antenna structure 1 is essentially directed to the direction $L_1$ (but still in the main plane M), as shown by the radiation pattern of FIG. 7. The further embodiments shown in FIGS. 5 and 6 have a different arrangement of the series of vias 4 in the intermediate parts 7*b*, which will be explained further below. The length $l_5$ of the intermediate parts 7*b* is between 3% and 15%, preferably between 5% and 10% and in the shown example 7.5% of the length $l_2$ of the conductive layers 3*a*, 3*b*. Advantageously, the intermediate parts 7*b* and the end parts 7*a* have the same length.

The antenna structure 1 of the present invention further comprises a middle region 9 which is adjacent to the intermediate region 7*b* of the end region 7. In the middle region 9, the series of conductive vias 4 is arranged essentially along a straight line. In the shown embodiment, the straight line is the middle line C of the conductive layers 3*a*, 3*b* in the length direction, which is separating the conductive layers 3*a*, 3*b* in the middle, i.e. at a distance of $W_2/2$ to each longitudinal side 14*a* and 14*b*. The length $l_4$ of the middle region 9 is advantageously between 30% and 70%, preferably between 40% and 60%, in the shown example about 50% of the length $l_2$ of the conductive layers 3*a*, 3*b*.

As discussed above, the antenna structure 1 of the present invention may further comprise the feeding structure 12 coupled to that feeding end 5. In the first embodiment shown in FIG. 1, the feeding structure 12 is part of the antenna structure 1, which is advantageous in relation to the integration and the manufacturing of the device. However, in specific applications, it might be advantageous not to include a feeding structure in the antenna structure 1. Between the feeding end 5 and the middle region 9, the antenna structure 1 comprises a feeding region 13, whereby the series of conductive vias 4 arranged in said feeding region 13 is arranged closer to the side 14*b* of the wave guide than to the side 14*a* at or adjacent to which a feeding structure 12 may be coupled (i.e. the side 14*a* forming the magnetic wall for the electromagnetic signals). The length $l_3$ of the feeding region 13 is advantageously between 20% and 50%, preferably between 30% and 40%, in the shown example about 35% of the length $l_2$ of the conductive layers 3*a*, 3*b*.

The antenna structure 10 of the second embodiment shown in FIG. 5 and the antenna structure 11 of the third embodiment shown in FIG. 6 are identical to the antenna structure 1 of the first embodiment, except the arrangement of the series of conductive vias 4 in the intermediate parts 7*b* of the end regions 7. In the antenna structure 10 of the second embodiment, the series of vias 4 in the intermediate part 7*b* is arranged essentially along the same middle line C of the conductive layers 3*a*, 3*b* in the length direction as the series of conductive vias in the middle region 9, hereby, the radiation pattern of the antenna structure 10 essentially extends and points in the length direction L of the antenna structure, but still within the main plane M, as shown by the radiation pattern of FIG. 8.

The series of vias 4 in the intermediate part 7*b* of the end region 7 of the antenna structure 11 of the third embodiment shown in FIG. 6, similar as in the first embodiment, is arranged in an angle to the middle line C or the longitudinal direction, so that the series of vias in the intermediate part 7*b* of the third embodiment points in a direction $L_2$ which is arranged in an angle, e.g. between 10° and 30° to the longitudinal direction L of the antenna structure. Hereby, the radiation pattern of the antenna structure 11 is essentially pointing in the direction $L_2$, but still in the main plane M, as shown by the radiation pattern of FIG. 9.

It has to be noted that FIGS. 1, 5 and 6 only show the topside conductive layer 3*a* and that most of the above explanations are thus in relation to this conductive layer 3*a*, but all features and characteristics are identically applicable to the conductive layer 36 on the bottom side 26 of the dielectric 2.

The invention claimed is:

1. Half mode substrate integrated antenna structure for electro-magnetic signals, comprising:

a substrate with a top and a bottom side, said substrate being at least partially of a flat shape with a main plane, a conductive layer arranged on said top and a conductive layer arranged on said bottom side, a single series of conductive vias extending between the conductive layers of the top and the bottom side of the substrate so that a waveguide having a feeding end and an antenna end is formed, wherein a radiation pattern having a main lobe is radiated from said antenna end, wherein said antenna end is formed by end regions of said conductive layers and said substrate so that said main lobe of the radiation pattern of said antenna structure essentially extends in the main plane.

2. Half mode substrate integrated antenna structure according to claim 1, wherein said conductive layers and said substrate at said antenna end form an open end structure.

3. Half mode substrate integrated antenna structure according to claim 1 or 2, wherein said series of vias extends along a length ($l_2$) of said antenna structure from said feeding end towards said antenna end, and wherein end parts of said end regions of said conductive layers are free of conductive vias, said end parts being in a virtual extension of the series of conductive vias.

4. Half mode substrate integrated antenna structure according to claim 3, wherein a length ($l_6$) of said end parts is between 3% and 15% of the length ($l_2$) of said conductive layers.

5. Half mode substrate integrated antenna structure according to claim 3, wherein the series of vias in intermediate parts of said end regions adjacent to said end parts is arranged essentially along a middle line of said conductive layers in a length direction ($L_0$) so that the radiation pattern of said antenna structure essentially extends in a length direction (L) of the antenna structure.

6. Half mode substrate integrated antenna structure according to claim 5, wherein a length ($l_5$) of said intermediate regions is between 3% and 15% of the length of said conductive layers.

7. Half mode substrate integrated antenna structure according to claim 5, wherein a length ($l_5$) of said intermediate regions is between 5% and 10% of the length of said conductive layers.

8. Half mode substrate integrated antenna structure according to claim 3, wherein the series of vias in intermediate parts of said end regions adjacent to said end parts is arranged essentially at an angle to a middle line of said conductive layers in a length direction (L) so that the radiation pattern of said antenna structure essentially extends in the direction of said angle.

9. Half mode substrate integrated antenna structure according to claim 3, wherein a length ($l_6$) of said end parts is between 5% and 10% of the length ($l_2$) of said conductive layers.

10. Half mode substrate integrated antenna structure according to claim 3, wherein a length ($l_6$) of said end parts is bigger than a spacing between two vias of said series of conductive vias.

11. Half mode substrate integrated antenna structure according to claim 2, wherein said end parts of the conductive layers at the antenna end extend to an edge or the side of the substrate so that electromagnetic waves guided along the wave guide can be radiated from this open end without obstructions.

12. Half mode substrate integrated antenna structure according to claim 1, wherein said waveguide comprises a middle region in which the series of vias is arranged essentially along a straight line.

13. Half mode substrate integrated antenna structure according to claim 12, wherein said straight line is the middle line of said conductive layers in a length direction (L), wherein the middle line separate said conductive layer in the middle and extends in the length direction.

14. Half mode substrate integrated antenna structure according to claim 12, wherein a length ($l_4$) of said middle region is between 30% and 70% of a length ($l_2$) of said conductive layers.

15. Half mode substrate integrated antenna structure according to claim 12, wherein a length ($l_4$) of said middle region is between 40% and 60% of a length ($l_2$) of said conductive layers.

16. Half mode substrate integrated antenna structure according to claim 1, further comprising:

a feeding structure coupled to said feeding end of said waveguide at or adjacent to a side wall thereof, wherein said waveguide comprises a feeding region adjacent to said feeding end, wherein the series of vias arranged in said feeding region is arranged closer to a opposite sidewall of the waveguide than to the sidewall at or adjacent to which the feeding structure is coupled.

17. Half mode substrate integrated antenna structure according to claim 16, wherein a length ($l_3$) of said feeding region is between 20% and 50% of a length ($l_2$) of said conductive layers.

18. Half mode substrate integrated antenna structure according to claim 16, wherein the length ($l_3$) of said feeding region is between 30% and 40% of a length ($l_2$) of said conductive layers.

19. Half mode substrate integrated antenna structure according to claim 1, further comprising a feeding structure in form of printed conducting lines coupled to said feeding end and not to said antenna end.

* * * * *